United States Patent [19]

Mueller

[11] Patent Number: 5,001,889

[45] Date of Patent: Mar. 26, 1991

[54] APPARATUS FOR BAGGING FOODSTUFFS

[75] Inventor: Alan C. Mueller, Antigo, Wis.

[73] Assignee: Volm Bag Company, Inc., Antigo, Wis.

[21] Appl. No.: 411,360

[22] Filed: Sep. 22, 1989

[51] Int. Cl.[5] ..... B65B 1/32; B65B 1/08; B65B 43/50

[52] U.S. Cl. ..... 53/502; 53/69; 53/167; 53/249; 53/525; 141/314

[58] Field of Search ..... 53/502, 506, 272, 250, 53/249, 69, 67, 525; 141/314, 313

[56] References Cited

U.S. PATENT DOCUMENTS

| | | | |
|---|---|---|---|
| 2,654,518 | 10/1953 | Kindseth | 141/314 X |
| 2,784,749 | 3/1957 | Baker | 141/314 |
| 2,949,714 | 8/1960 | Davis | 53/506 X |
| 3,097,459 | 7/1963 | Rausch | 141/314 X |
| 3,215,173 | 11/1965 | Rutherford | 141/314 X |
| 3,406,727 | 10/1968 | Rexus | 141/314 X |
| 3,416,620 | 12/1968 | McClusky | 53/502 X |
| 3,498,020 | 3/1970 | Eppenberger | 53/502 X |
| 3,540,497 | 11/1970 | Troyer | 141/314 |
| 3,842,569 | 10/1974 | McClelland et al. | 53/167 X |
| 4,526,214 | 7/1985 | McGregor | 141/314 X |

OTHER PUBLICATIONS 2 page brochure by Filper, dated 12/79, entitled Weighomatic.

*Primary Examiner*—James F. Coan

*Attorney, Agent, or Firm*—Merchant, Gould, Smith, Edell, Welter & Schmidt

[57] ABSTRACT

An apparatus for bagging foodstuffs such as potatoes includes a carousel having a number of hopper recesses defined in a top surface and an electric motor and transmission assembly for rotatably moving the carousel. Each of the hoppers terminates in a chute for guiding the foodstuffs, and the carousel is vibrated in two separate directions in order to prevent the foodstuffs from becoming stuck. An automatic bag gripping mechanism is provided beneath each of the chutes, and is adapted to close when a bag is placed into position between its grippers when the carousel is in a first position. A control and interface unit continuously moves the carousel from the first position to a second loading position, and interfaces with a commercially available weighing machine to control the transfer of a load of foodstuffs from the weighing machine into one of the hoppers. After loading, the carousel continues to move to a third position in which the bag gripping mechanism automatically opens to permit removal of the bagged foodstuffs.

28 Claims, 7 Drawing Sheets

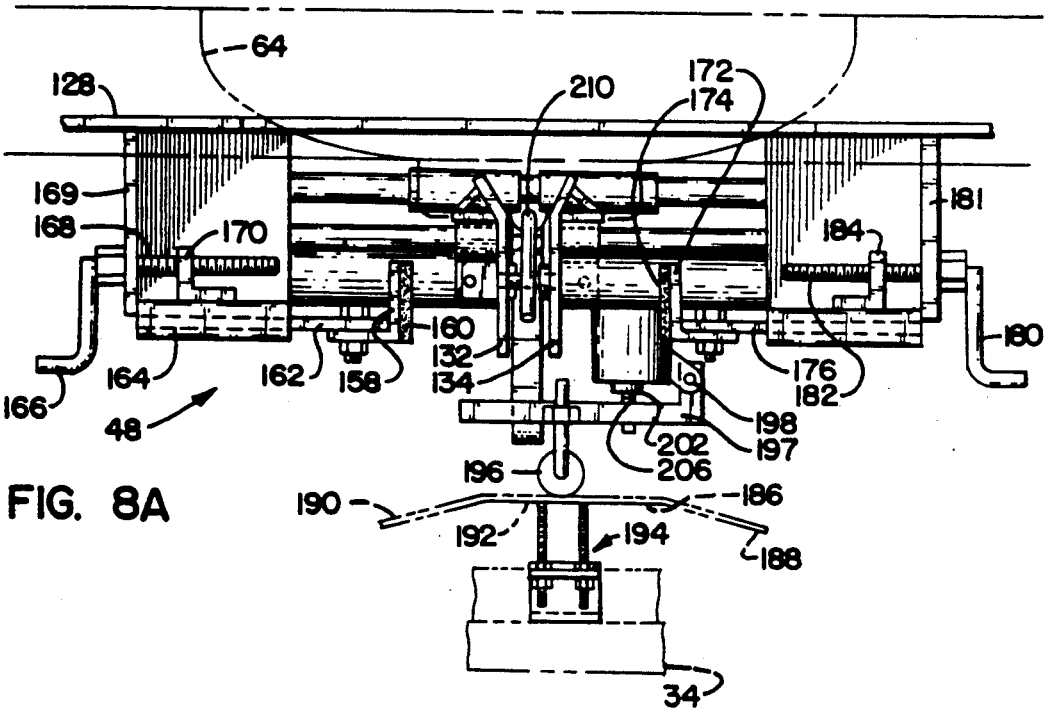
FIG. 8A
FIG. 8B
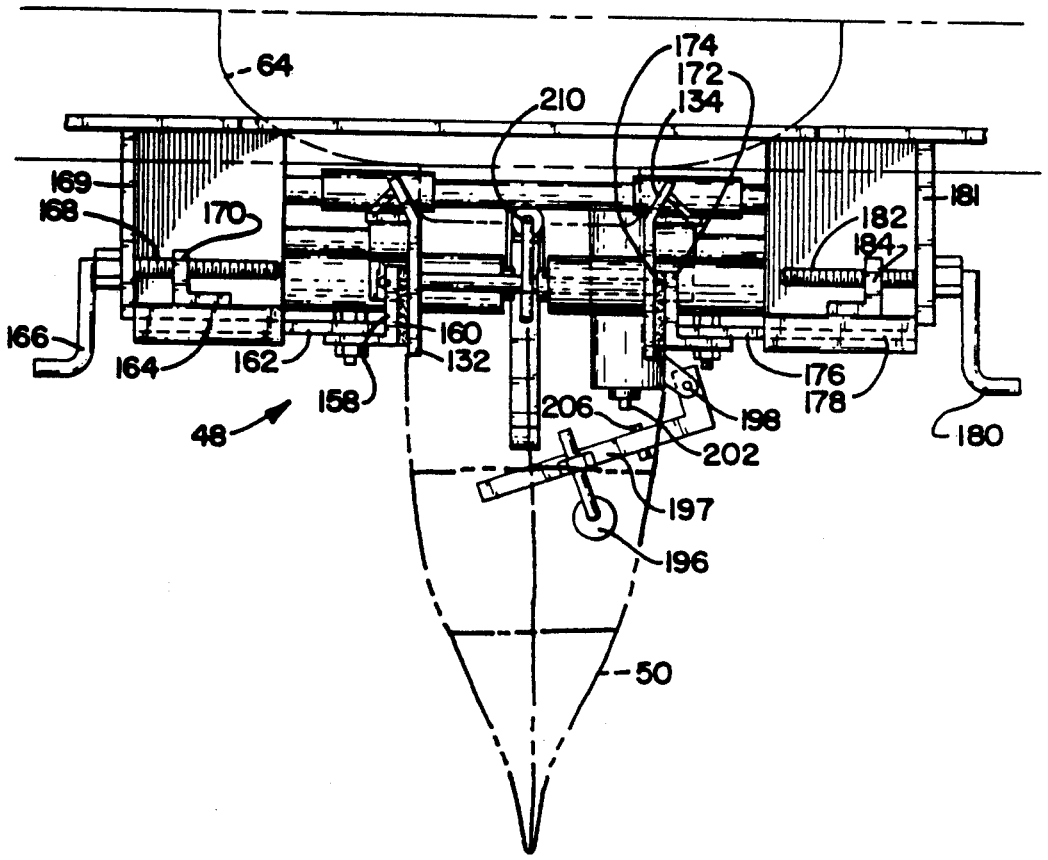

APPARATUS FOR BAGGING FOODSTUFFS

BACKGROUND OF THE INVENTION

1. Field of the Invention

This invention relates generally to systems for handling and packaging agricultural products or foodstuffs. More specifically, this invention relates to an improved apparatus for bagging pre-measured loads of foodstuffs such as potatoes.

2. Description of the Prior Art

In contemporary society, price competition among food producers requires that the processing, handling and packaging of agricultural products or other foodstuffs be automated as much as possible. This is particularly true in the potato-bagging industry, because of the enormous volume and weight of the potatoes which are handled in the typical potato-bagging plant during the season. In response to this strong economic incentive, machines have been developed which separate the bulk quantities of potatoes into discrete loads of like weight. An example of such a machine is the Lockpack Multi MC-12DP weighing machine which is commercially available from Lockwood International BV of Nieuw-Amsterdam in the Netherlands.

Although such machines were relatively efficient at providing pre-weighed loads of potatoes, production was still limited by the time that it took to put them into bags for distribution. Although automatic baggers have been tried with the weighers, none of these baggers are compatible with the type of pre-made paper and mesh bags which are commonly in use throughout the industry. Other types of baggers which are compatible with such bags do not lend themselves to use with the weighing machines.

It is clear that there has existed a long and unfilled need in the art for an apparatus which can bag potatoes or other foodstuffs in an efficient manner using commercially available, pre-made bags, and which is compatible for use with the computerized weighing machines which are available today.

SUMMARY OF THE INVENTION

Accordingly, it is first object of this invention to provide an apparatus for bagging foodstuffs such as potatoes in commercially available, pre-made bags, which is efficient and requires minimal human intervention.

It is a second object of the invention to provide an improved apparatus for bagging foodstuffs which is compatible with the type of automatic weighing machines which are commercially available today.

In order to achieve these and other objects of the invention, an apparatus for bagging foodstuffs or like articles according to the invention includes hopper structure which is adapted for receiving a pre-measured quantity of foodstuffs, the hopper structure including a downwardly directed chute; gripper structure, positioned beneath the chute, which is adapted for selectively gripping or releasing a pre-made bag; conveying structure for moving the hopper structure and the gripper structure together as a unit; and structure for controlling the gripper structure and the conveying structure so that the gripper structure is caused to (a) grip a bag when the conveying structure is in a first position; (b) position the conveying structure at a second position, whereupon foodstuffs may be loaded into the hopper structure; and (c) cause the gripping structure to release the bag at a third position, whereby such foodstuffs may be efficiently bagged.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIGS. 8A and 8B are fragmentary side elevational views of a gripping mechanism in the embodiment of FIGS. 1–7;

DETAILED DESCRIPTION OF THE PREFERRED EMBODIMENT(S)

Figure 1:
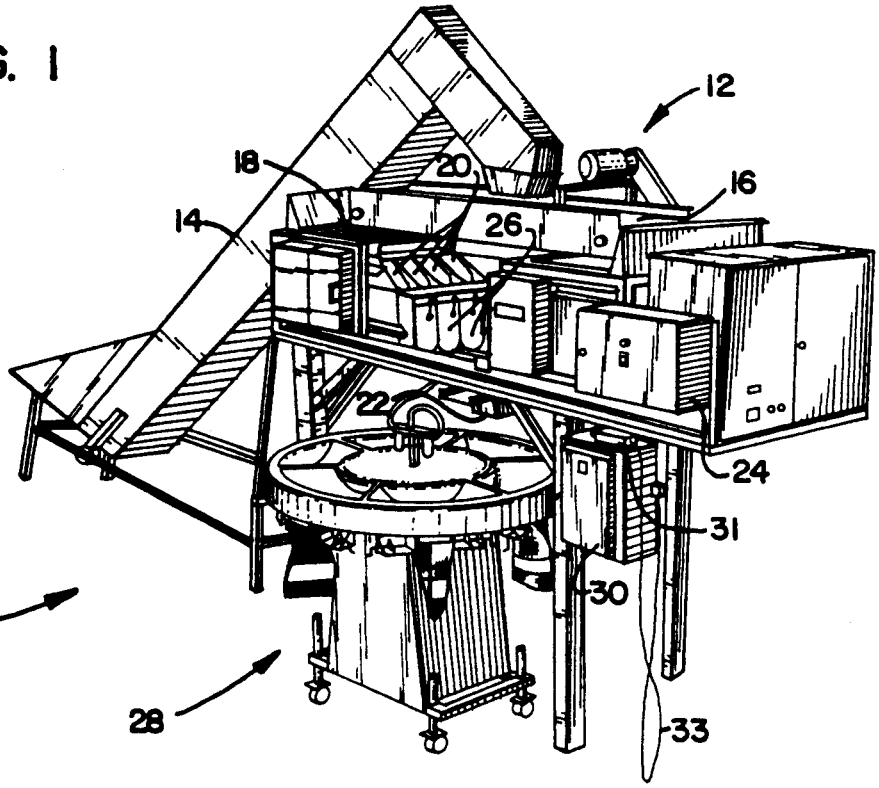
FIG. 1 is a perspective view of an apparatus according to the invention along with a commercially available weighing machine.

Referring now to the drawings, wherein like reference numerals designate corresponding structure throughout the views, and referring in particular to FIG. 1, an improved potato-packaging assembly 10 according to the invention includes a commercially available weighing machine 12. Preferably, the weighing machine 12 is a Lockpack Multi MC12DP, which is commercially available from Lockwood International BV, in Nieuw-Amsterdam, the Netherlands. The weighing machine 12 includes a conveyor 14 for conveying bulk quantities of potatoes or other foodstuffs into a reversal feeding conveyor 16, which selectively loads potatoes into opposite feeding hoppers 18. The hoppers 18 feed the potatoes through vibrator channels 20 and into weighing buckets 26. The operation of the various above-described elements of the weighing machine 12 is well-known to those skilled in the art and does not need to be further described. A hopper 22 is provided for guiding the pre-weighed loads of potatoes into an open space which is beneath the weighing machine 12. A control panel 24 contains circuitry for automatically operating the various components of the weighing machine 12.

According to the invention, a novel produce bagging apparatus 28 is provided in the open space which is defined beneath the weighing machine 12. Bagging apparatus 28 includes a control and interface unit 30, which is in communication with the control panel 24 of the weighing machine 12 in a manner which will be described in greater detail below. A hand control unit 31 is connected to the control and interface unit by means of a control bus 33.

Figure 2:
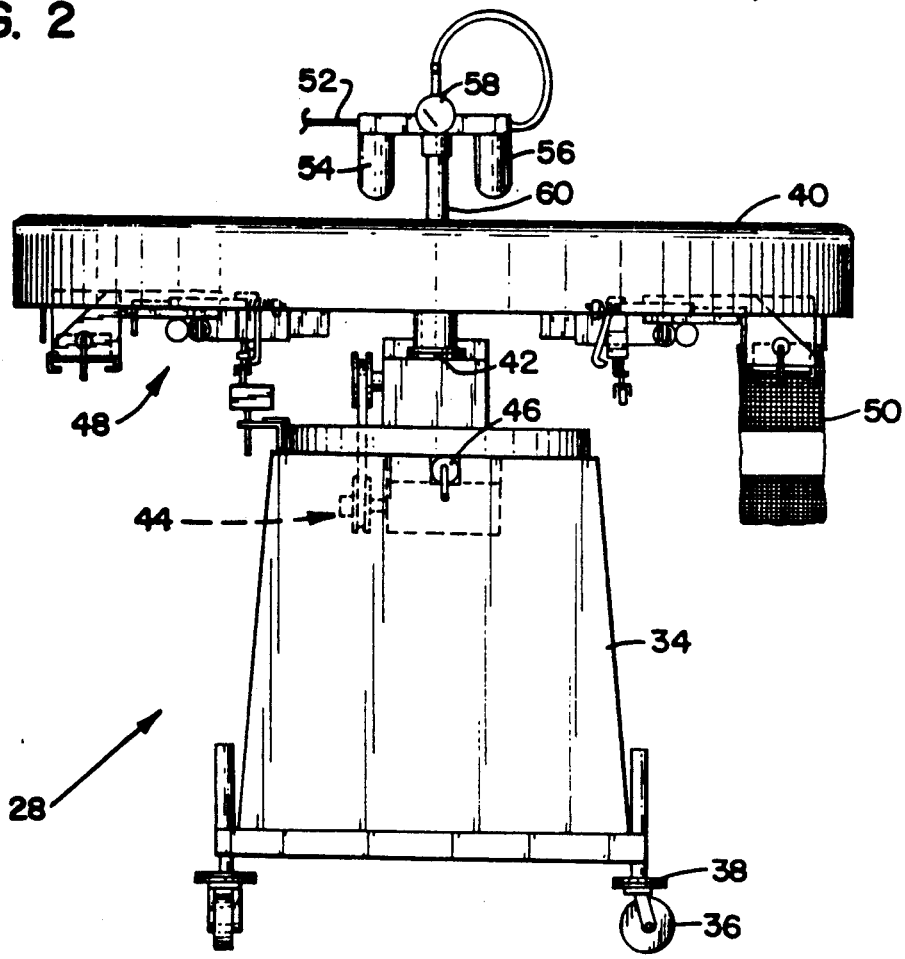
FIG. 2 is a side elevational view of the apparatus which is shown in FIG. 1.

Referring now to FIG. 2, the bagging apparatus 28 includes a lower housing 34 which is supported on the ground by a number of caster wheels 36. Each of the caster wheels 36 is mounted in a swivel 38. The caster wheels 36 provide portability to the bagging apparatus, which allows the bagging apparatus 28 to be moved from its position beneath the weighing machine 12 with a minimum of effort.

As is also shown in FIG. 2, a carousel 40 is mounted horizontally for pivotal movement with respect to lower housing 34 by a thrust bearing 42. A carousel drive mechanism 44 is provided for rotating the carousel 40. The carousel drive mechanism 44 will be described in greater detail hereinbelow. As may be seen in FIG. 2, a speed control level 46 is provided to vary the transmission ratio of the carousel drive mechanism 44, for purposes which will be described hereinafter.

An automatic bag-gripping mechanism 48 is provided at each of six bag filling stations 62 and is mounted to an underside of the carousel 40, as is shown in FIG. 2. The automatic bag-gripping mechanism is constructed so as to be able to releasably clamp a bag 50 in an open position beneath each of the bag-filling stations 62. The bagging apparatus 28 is powered in part by a pneumatic supply 52 which is provided with a water filter 54, an oiler 56 and a gauge 58. Gauge 58 monitors the pneumatic pressure within a main supply pipe 60 which extends axially with respect to the rotatable carousel 40.

Figure 3:
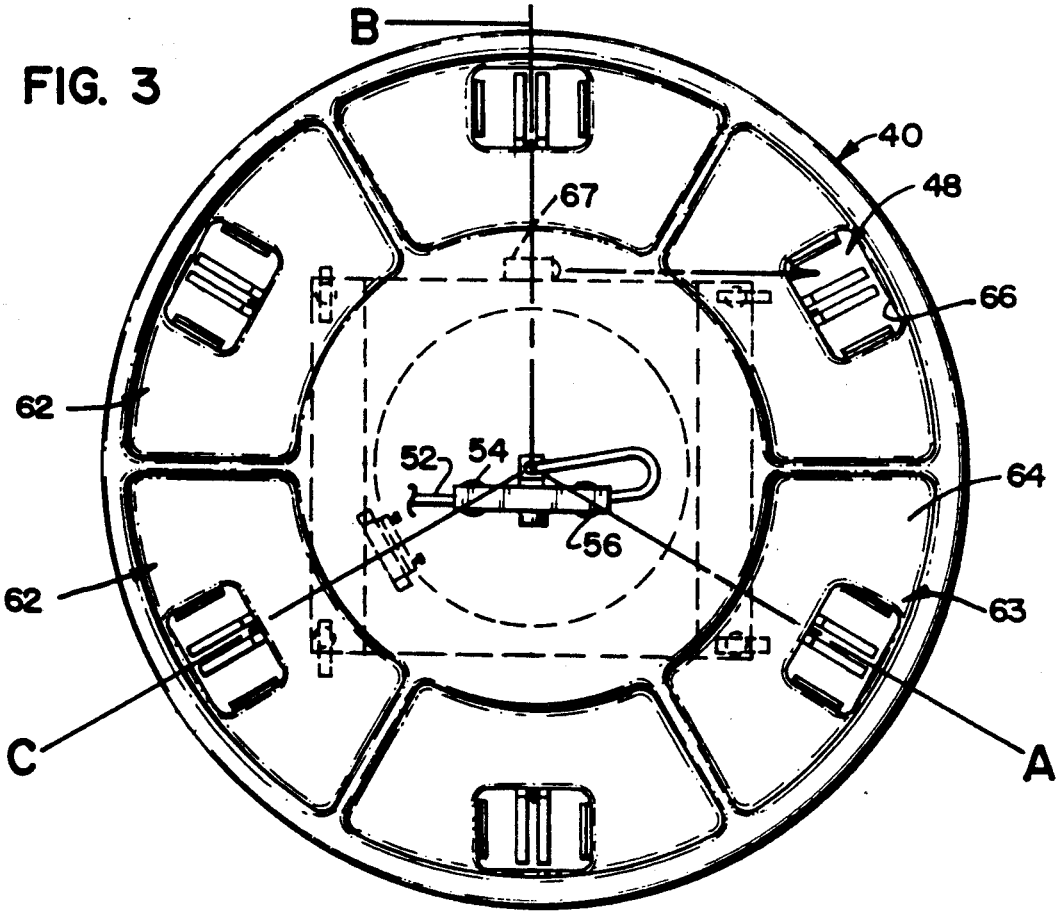
FIG. 3 is a top plan view of the apparatus which is shown in FIGS. 1 and 2.

As is shown in FIG. 3, each of the bag-filling stations 62 includes a hopper 63, which is formed as a tublike recess in the top surface of the rotatable carousel 40. Each of the six hoppers 63 includes a central downwardly directed chute portion 64 which defines an opening 66 in the main body of the rotatable carousel 40.

As may be seen in FIG. 3, each of the six separate bag-filling stations 62 are rotatable between a first bag application station A, a second potato loading station B and a third bag-release station C. A photosensor 67 is mounted to a side surface of lower housing 34 for detecting the presence of a bag at the potato loading station B.

Figure 4:
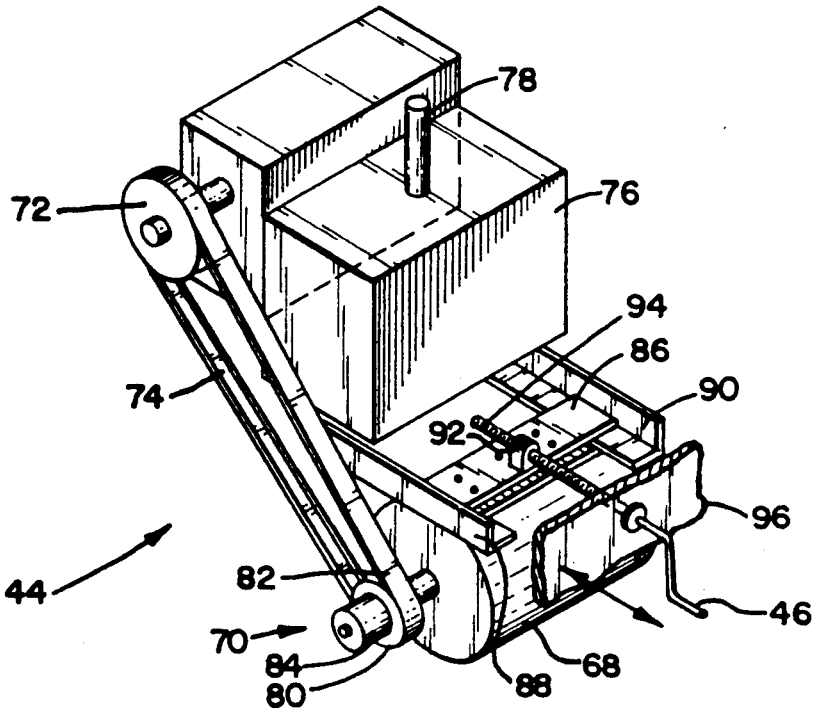
FIG. 4 is an isolation view of a transmission arrangement in the apparatus which is depicted in FIGS. 1–3.

Referring now to FIG. 4, the carousel drive mechanism 44 will now be described in detail. With reference to FIG. 4, an electric step motor 68 is connected to drive a variable pitch pulley 70. The variable pitch pulley 70 is connected for rotation with a constant pitch pulley 72 via an endless V-type drive belt 74. Pulley 72 is connected to a transfer gear box 76 which outputs in a carousel drive shaft 78 which is connected to rotatably drive the carousel 40. The variable pitch pulley 70 is of conventional design, and includes a first moveable sheath 80, a second fixed sheath 82 and a device 84 which axially biases the first moveable sheet 80 toward the second fixed sheath 82. The electric motor 68 is mounted to a support plate 86, as may further be seen in FIG. 4. Support plate 86 is constrained to slide relative to a pair of channel members 88,90 and includes a threaded block 92 which is threadedly engaged by a threaded rod 94. Rod 94 further is rotatably engaged but axially fixed with respect to a bore that is provided in a frame end plate 96. The frame end plate 96 is integral with the channel members 88, 90. When the control lever 46 is turned, the support plate is forced toward or away from the frame plate 96, depending on the direction in which the control lever 46 is turned. This in turn changes the distance between the variable pitch pulley 70 and the constant pitch pulley 72. When the variable pitch pulley 70 is forced away from the constant pitch pulley 72 by turning the control lever 46, the tension which is provided by drive belt 74 causes the first sheath 80 to be forced axially away from the second sheath 82 against the biasing of device 84, thereby changing the pitch of the variable pitch pulley 70 and thus varying the transmission arrangement of the carousel drive mechanism 44 as a whole. When the variable pitch pulley 70 is pushed toward the constant pitch pulley 72, its pitch and the transmission ratio of the mechanism 44 change, accordingly, in the reverse manner.

Figure 5:
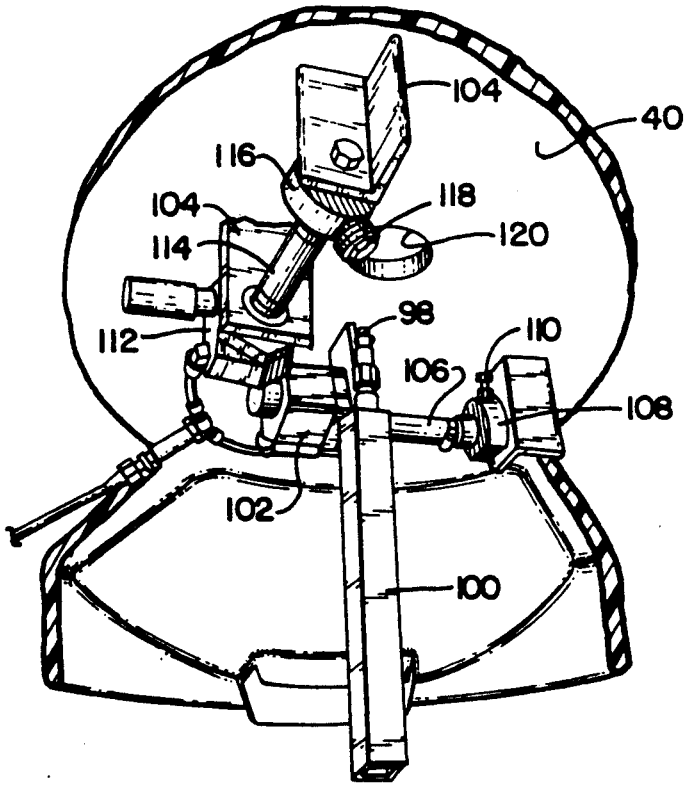
FIG. 5 is a fragmentary view of an inner portion of the apparatus which is depicted in FIGS. 1–4.

Referring now to FIG. 5, a pneumatic supply pipe 100 may be pneumatically connected to the supply pipe 60 via a nipple connection 98, which is positioned beneath the lower surface of the rotatable carousel 40. In order to help guide potatoes or like foodstuffs from the various hoppers 63 down through their corresponding chute portions 64, a mechanism is provided for imparting vibration to the upper surface of the rotatable carousel 40. This mechanism includes a first pneumatic motor 92, which is fed by a pneumatic supply line 122 and is positioned adjacent one of several bearing blocks 104, which in the illustrated embodiment are constructed of angled channel members. The first pneumatic motor 102 drives a shaft 106, which is secured for rotation with respect to two of the bearing blocks 104. Shaft 106 has an eccentric member 108 mounted thereon to create a rotating vibrational imbalance when the shaft 106 is rotated by motor 102. As may clearly be seen in FIG. 5, the center of mass of the eccentric member 108 may be adjusted by moving a bolt 110 radially toward or away from the access of shaft 106.

As may also be seen in FIG. 5, a second pneumatic motor 112 is also mounted to the underside of carousel 40, and is arranged to drive a second shaft 104 which extends in a direction which is perpendicular to the direction of the first shaft 106. A second eccentric member 116 is provided on second shaft 114. The second eccentric member 116 likewise may have its center of mass adjusted by moving an eccentric bolt 118 radially toward or away from the access of second shaft 114. An access opening 120 is defined in the upper carousel 40 to permit passage of the main pneumatic supply pipe 60.

Figure 6:
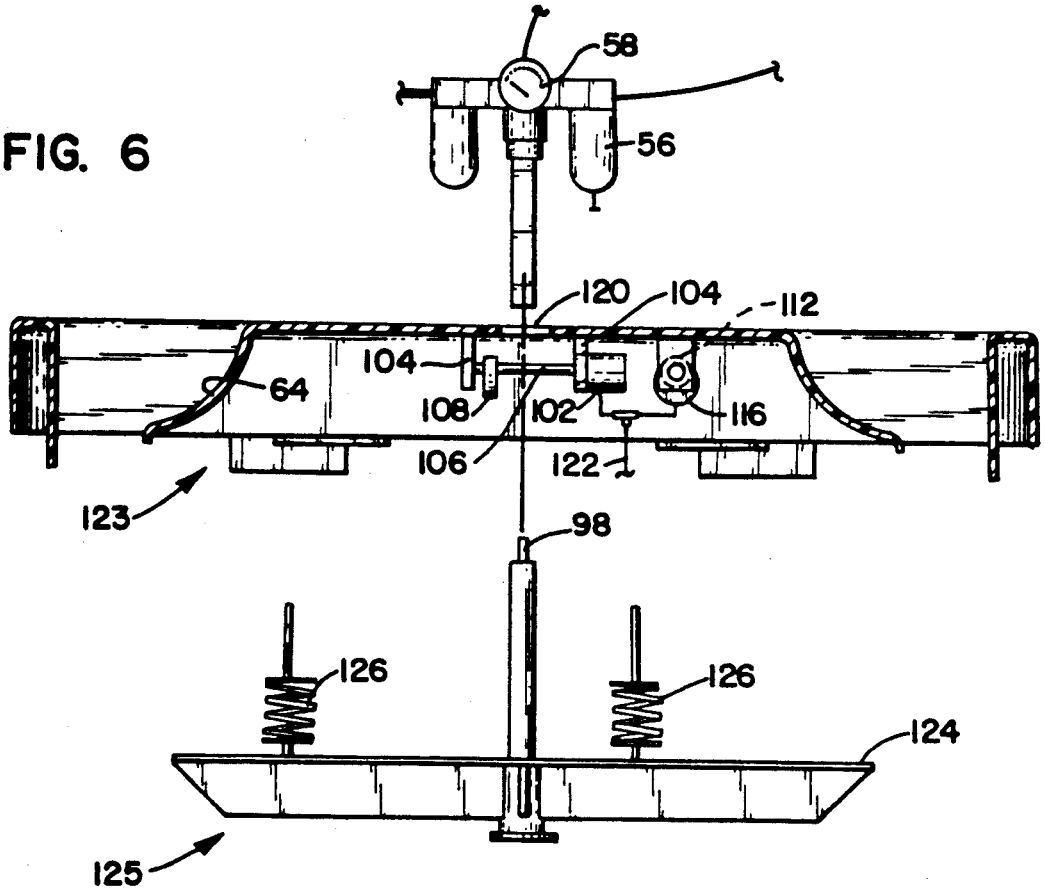
FIG. 6 is an exploded isolational view of a portion of the apparatus which is shown in FIGS. 1–5, depicted partially in cross-section.

As is evident from FIG. 6, the carousel 40 is separated into an upper carousel member 123 and a lower carousel member 125. The upper carousel member 123 is supported with respect to the lower carousel member 125 by means of three equilaterally positioned springs 126 which are connected to an upper carousel support platform 124 and to the lower surface of the upper carousel member 123. Accordingly, the first and second pneumatic motors 102, 112 will cause the upper carousel member 123 to vibrate with respect to lower member 125 and the remainder of the bagging apparatus 128 in two separate, perpendicular planes, which aids in the passage of the foodstuffs from the hoppers 63 down through their corresponding chutes 64.

Figure 7:
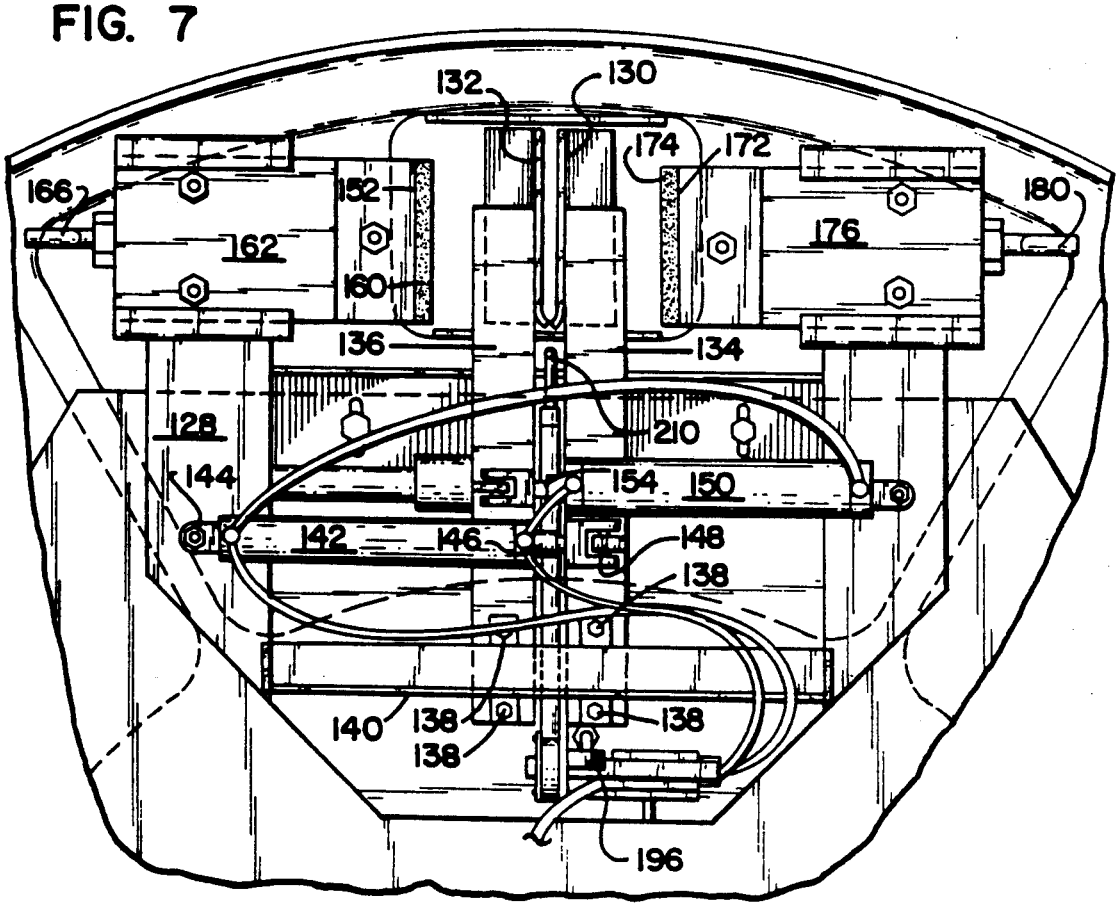
FIG. 7 is a fragmentary bottom plan view of a portion of the apparatus depicted in FIGS. 1–6.

Referring now to FIG. 7, the operation of each of the bag-gripping mechanisms 48 will now be described in detail. A right moveable gripper 130 and a left moveable gripper 132 are mounted for sliding movement with respect to a frame 128 of the carousel 40. Specifically, the right moveable gripper 130 is integral with a right gripper bar 134, while the left moveable gripper 132 is likewise integral with a left gripper bar 136. Both the right gripper bar 134 and the left gripper bar 136 are provided at ends which are opposite the respective grippers 130, 132, with a pair of guide bolts 138. The guide bolts 138 effectively create a track in each of the gripper bars 134,136, which enable the respective gripper bar to slide linearly with respect to an angle iron 140 that is integral with frame 128 and which extends in a direction which is substantially perpendicular to the longitudinal axis of each of the gripper bars 134, 136.

A first pneumatic cylinder 142 includes a cylinder portion which is connected at a first end 144 to frame 128, and a piston portion 146 which is connected to the right gripper bar 134 via a pivot joint 148. A second piston cylinder assembly 150 has its cylinder connected at a first end 152 to frame 128, and a piston portion 154 thereof with the left gripper bar 136 via a second pivot joint. Thus, the left gripper 132 may be moved by actuating the second piston cylinder assembly 150, and the right gripper member 134 may be moved by actuating the first piston cylinder assembly 142.

Referring now to FIGS. 8A and 8B, it will be seen that gripping mechanism 48 further includes a left stationary gripper member 158 and a right stationary gripper member 172. The left stationary gripper member 158 includes a gripper surface 160 which is mounted outside of and is arranged to face the left moveable gripper member 132. The left stationary gripper member 158 is adjustable by a slide plate 162, which is constructed to slide within a support sleeve 164 and which is integral to a follower bracket 170. The follower bracket 170 is threadedly engaged with a threaded rod 168, which can be rotated by pivoting a left gripper adjustment crank 166. Adjustment crank 166 is axially fixed with respect to a projection 169 of the carousel frame 128. Similarly, right stationary gripper member 172 is provided with a gripper surface 174 that is positioned to face the right moveable gripper member 134. A slide plate 176 is integrally connected to gripper member 172 and is mounted for sliding movement within a support sleeve 178, which like the support sleeve 164 is formed of a pair of angle members. A follower bracket 184 is integrally connected to slide plate 176 and is threadedly engaged by a rod 182 which is mounted so as to be rotatable with respect to a projection 181 of the carousel frame 128. The follower bracket 184 and thus the gripper member 172 may be adjusted relative to the projection 181 and the right moveable gripper member 134 by rotating a right gripper adjustment crank 180, which is secured to threaded rod 182.

As is best shown in FIG. 8A, a cam plate 186 is adjustably mounted with respect to the lower housing 34 of the bagging apparatus 28. Cam plate 186 includes a first downwardly inclined portion 188 and a second downwardly inclined portion 190 which are connected by a central, flat portion 192. Plate 186 is vertically adjustable with respect to lower housing 34 by a bolt-nut type adjustment mechanism 194. During operation of the apparatus 28, the cam plate 186 is engageable with a follower wheel 196 which is provided in each of the gripping mechanisms 48. Each of the follower wheels 196 is adjustably mounted with respect to a cam follower arm 197 that is pivotally mounted with respect to frame 128 at a pivot joint 198. As may be seen in FIG. 10, follower wheel 196 is connected to the follower arm 197 by a threaded rod 108 which threadedly engages arm 197, which permits vertical adjustment of the rod 208 with respect to arm 197. As may also be seen in FIGS. 8B and 10, a projection 206 is provided on an upper surface of the cam follower arm 197.

Figure 9:
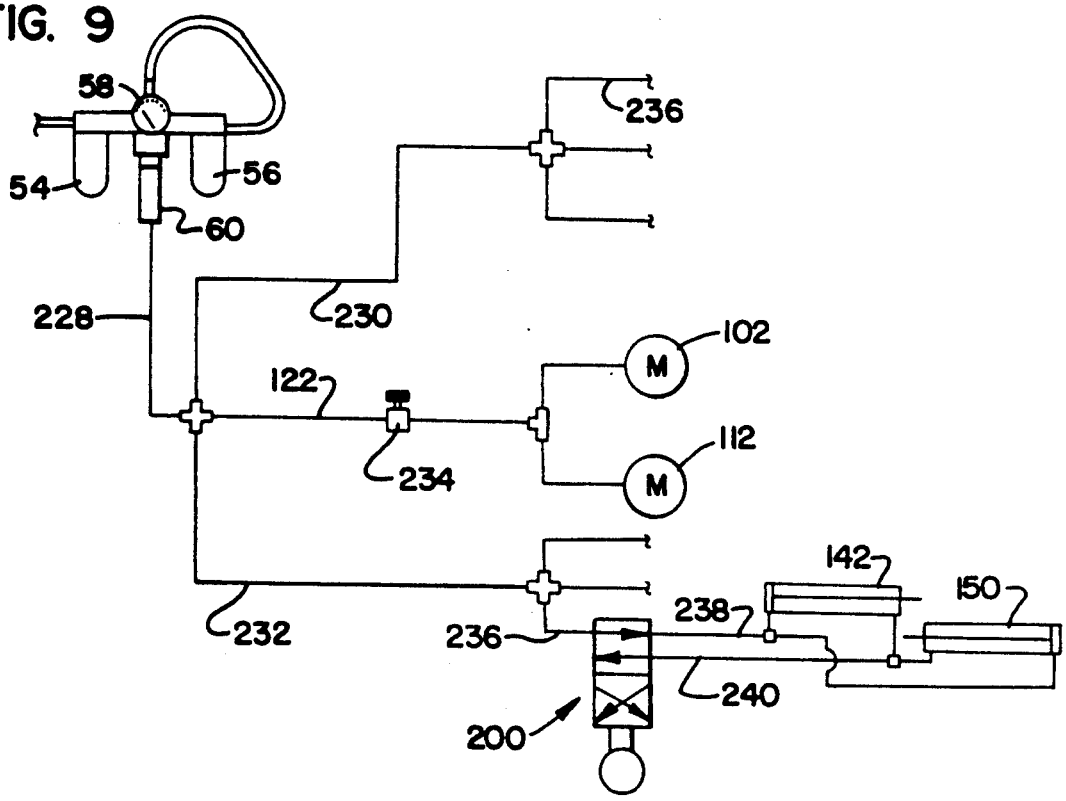
FIG. 9 is a schematic diagram illustrating the pneumatic distribution system of the apparatus shown in FIGS. 1–8.
Figure 10:
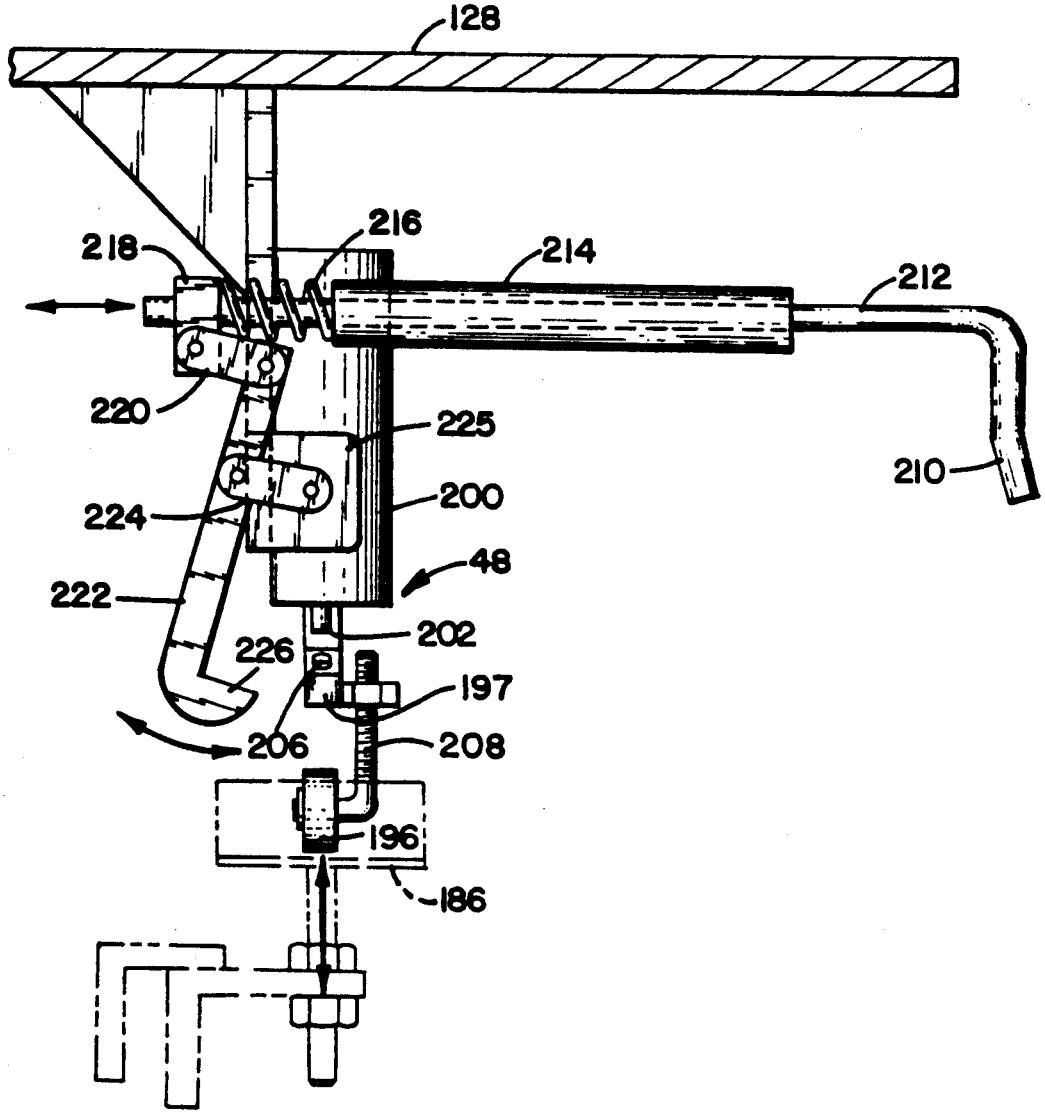
FIG. 10 is a side elevational fragmentary view of a gripper actuation mechanism in the apparatus which is shown in FIGS. 1–9.

As may be seen in FIG. 10 and in the schematic diagram which is provided in FIG. 9, a pneumatic valve 200 is provided to control operation of the first and second cylinder assemblies 142, 150. Valve 200 includes an actuator 202 which is axially displaceable to control the position of valve 200 as it is represented in FIG. 9. A curved rod forms a bag engaging projection 210 and a push rod 212 that is mounted for axial sliding displacement within a guide sleeve 214, as is shown in FIG. 10. An end block 218 is secured to push rod 212 and is biased away from guide sleeve 214 by a compression spring 216, as is also shown in FIG. 10. End block 218 is pivotally mounted to a first end of a first link 220, which is further pivotally mounted at its second end to a first end of a hook member 222. A central portion of hook member 222 is pivotally mounted with respect to a second link 224. A second, opposite end of the second link 224 is pivotally mounted with respect to a bracket 225 which is part of the carousel frame 128. A second end of the hook member 222 includes a hook portion having an inner, upper substantially flat engaging surface 226, as is best shown in FIG. 10. The operation of pneumatic valve 200 and the actuating mechanism which is shown in FIG. 10 will be described in greater detail below.

Turning now to FIG. 9, the pneumatic supply system includes a main supply conduit 228 that is connected to main supply pipe 60 and which comprehends the supply pipe 100 shown in FIG. 5. The main supply conduit 228 branches into a first gripper supply line 230, a second gripper supply line 232 and the vibrator supply line 122. The vibrator supply line 122 supplies the first and second pneumatic motors 102, 112. A variable orifice 234 is interposed within the vibrator supply line 122. By varying orifice 234, the volumetric flow of air to the motors 102, 112 may be controlled, which in turn controls the frequency of the motors and the vibration which they create. As may be seen in FIG. 9, both the first gripper supply line 230 and the second gripper supply line 232 terminate in three separate gripper cylinder supply conduits 236. Each of the supply conduits 236 are in turn communicable via valve 200 to the first and second piston cylinder assemblies 142, 150. When valve 200 is displaced downwardly, as is shown in FIG. 9, the supply conduit 236 is communicated to a first supply line 238 so as to cause both of the cylinders 142, 150 to extend. At this time, the chambers at the forward end of the cylinders 142, 150 are communicated via second supply line 240 through valve 200 to atmosphere. When valve 200 is displaced to its upward position, supply conduit 236 is communicated to the forward chamber, thus retracting both of the piston cylinder assemblies 142, 150. In this condition, the rearward chambers of both of the piston cylinder assemblies 142, 150 are communicated to vacuum.

Figure 11:
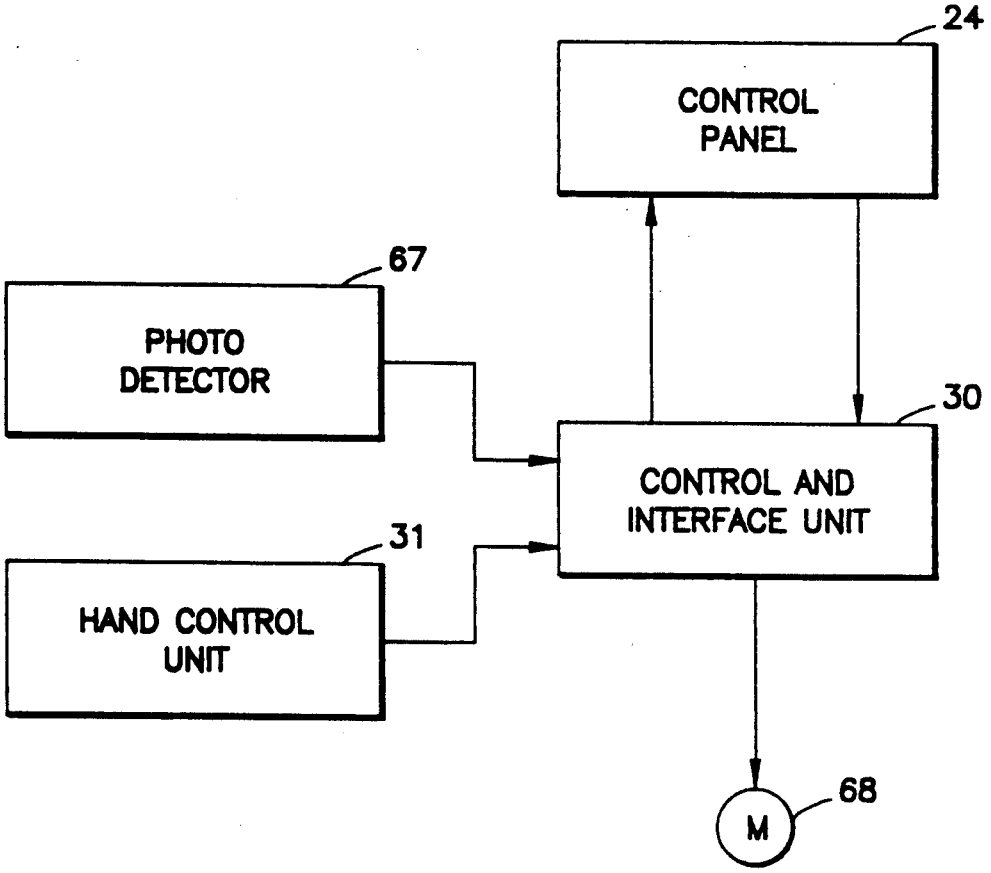
FIG. 11 is a block diagram which represents the operation of the control system for the apparatus depicted in FIGS. 1–10.

Looking now to FIG. 11, the control and interface unit 30 is in two-way communication with the control panel 24 of the weighing machine 12. Both the hand control unit 31 and photodetector 67 are electrically connected to the control and interface unit 30 for inputting respective signals thereto. As is further represented by FIG. 11, the electric motor 68 of the carousel drive 44 is controlled by a signal which is generated by the control and interface unit 30. The control and interface unit 30 is constructed, in the preferred embodiment, out of an ordinary relay based logic circuit, the specific design of which will be readily apparent to the person of ordinary skill in the art.

In operation, the improved potato packaging assembly 10 operates as follows. First, potatoes or other agricultural foodstuffs are loaded onto the conveyor 14 of weighing machine 12. Under the coordination which is provided by control panel 24, the foodstuffs are fed to a reversal feeding conveyor 16 into opposite feeding hoppers 18, vibrator channels 20 and weighing buckets 26, where the foodstuffs are subdivided into discrete loads of predetermined weight. At about this time, an operator energizes the bagging apparatus 28 by depressing a start button which is provided on the hand control unit 31. Compressed air is then independently supplied from source 52, which, starts the vibrator motors turning. The hand control unit 31 in turn sends a signal to the control and interface unit 30, which starts the electric motor 68 of the carousel drive 44. Accordingly, the carousel 40 is caused to continuously turn at this time. The speed of the carousel 40 may at this or at any later time be adjusted by turning the carousel speed control lever 46, which, as previously described, varies the transmission ratio between the pulleys 70, 72 which are illustrated in FIG. 4. At this time, an operator who is positioned at station A shall manually position a bag, open end up, so that opposite top ends of the bag, respectively, are positioned between the moveable gripper members 132, 134 and their respective stationary gripper members 158, 172. The operator then pulls the bag toward himself, which causes a rear lip of the top end of the bag to contact the bag-engaging projection 210 which is best shown in FIG. 10. This in turn, through the linkage which is provided by the first link 220, the second link 224 and the end block 218 causes hook member 222 to pivot in a clockwise direction so that its engaging surface 226 no longer supports the lower surface of the cam follower arm 197. Unsupported in this manner, cam follower arm 197 will pivot to the position which is illustrated in FIG. 8B. Once the projection 206 on cam follower arm 197 is no longer in contact with the actuator 202 of pneumatic valve 200, the actuator 202 is allowed to shift downwardly under the internal bias of pneumatic valve 200, which moves the valve 200 to the position which is schematically depicted in FIG. 9. At this time, compressed air is supplied to the first supply line 238 in order to extend both the first and second piston cylinder assemblies 142, 150. As a result, the bag is securely gripped in an open position by the automatic bag-gripping mechanism 48.

As the carousel continues to turn, the operator will sequentially place bags into the gripping mechanisms 48 as each of the respective bag filling stations 62 rotates past station A. When a bag filling station 62 approaches station B, photodetector 67 senses whether or not a bag is actually suspended from the gripping mechanism 48. If the photodetector 67 detects the presence of a bag, the control and interface unit 30, after a slight time delay, sends a signal to the control panel 24 of the weighing machine 12. In response, control panel 24 instructs the weighing machine 12 to dump a load of foodstuffs through the hopper 22 into the hopper 63 of the bag filling station 62 which is positioned at station B. The carousel 40 turns continuously throughout the dumping process.

After the weighing machine 12 dumps a load of foodstuff into one of the hoppers 63, control panel 24 sends a signal to the control and interface unit 30 which indicates that the dumping has occurred. If the control and interface 30 does not receive such a dumping signal from control panel 24 within a pre-determined time from when the control and interface unit 30 receives the signal from photodetector 67, the unit 30 will switch off drive motor 68. In other words, the carousel 40 will not continue to rotate if the weighing machine 12 cannot keep up with it. Once a signal indicating that the weighing machine 12 is ready to dump is transmitted from control panel 24 to control and interface unit 30, the control and interface unit 30 will restart motor 68 to continue the bagging process.

After a load of foodstuffs has been dumped into the hopper 63 of a bag filling station 62 which is positioned at station B, the carousel 40 will, if all is operating normally, continuously rotate to station C. Referring now to FIGS. 8A and 8B, at this point the follower wheel 196 will engage the second incline portion 190 of the cam plate 186, thereby causing follower arm 197 to pivot in a clockwise direction about the pivot joint 198. This causes projection 206 to engage the actuator 202 of pneumatic valve 200. As a result, valve 200 is moved to the position which is opposite that schematically depicted in FIG. 9. In this position, compressed air will be supplied to the second supply line 240, which causes each of the respective piston cylinder assemblies 142, 150 to contract. As may be seen in FIG. 7, this causes moveable gripper members 132, 134 to move away from their corresponding stationary grippers 158, 172, thus releasing the now filled bag from the automatic gripping mechanism 48. At this point, an operator can manually remove the bag. Alternately, an additional mechanism may be provided to effect this function.

As follower wheel 196 moves onto and across the flat portion 192 of the cam plate 186, the engaging surface 226 of hook member 222 can again become engaged with the underside of the cam follower arm 197. It continues to remain in this position as the bag filling station 62 continues to rotate with carousel 40 back to station A, whereupon an operator again places a bag between the grippers and the cycle is repeated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for bagging foodstuffs such as potatoes comprising:

hopper means adapted for receiving a pre-measured quantity of foodstuffs, said hopper means including a downwardly directed chute;

gripping means, positioned beneath said chute, which is adapted for selectively gripping or releasing a pre-made bag;

conveying means for moving said hopper means and said gripping means together as a unit in a continuous motion along a closed path; and means for controlling said gripping means and said conveying means so that said gripping means is caused to (a) grip a bag when said conveying means is in a first position along said closed path; (b) move said conveying means through a second position along said closed path, whereupon foodstuffs may be loaded into said hopper means; and (c) cause the gripping means to release the bag at a third position along said closed path, said controlling means further comprising means adapted for sending a signal to a weighing machine to dump a load of foodstuffs having a predetermined weight into said hopper means when said conveyor means travels through said second position, whereby such foodstuffs may be efficiently bagged.

2. An apparatus according to claim 1, further comprising means for imparting vibration to said hopper means, whereby foodstuffs are less likely to become stuck on said chute.

3. An apparatus according to claim 2, wherein said means for imparting vibration comprises first vibrating means for creating vibration in a first direction, and second vibrating means for creating vibration in a second direction.

4. Apparatus according to claim 1, wherein said gripping means comprises a pair of stationary outer grippers and a pair of movable inner grippers which are adapted to spread open a bag and clamp opposite sides of the bag against said stationary grippers.

5. Apparatus according to claim 4, wherein each of said stationary grippers are adjustable in order to permit bags having different sizes to be clamped in said gripping means.

6. Apparatus according to claim 1, wherein said conveying means comprises means for mounting said hopper means and said gripping means for rotation about an axis, and means for moving said hopper and gripper means about said axis.

7. Apparatus according to claim 6, wherein said moving means includes a continuously variable speed control.

8. Apparatus according to claim 1, wherein said controlling means comprises closing means for sensing when a bag is positioned within said gripping means and for closing said gripping means when a bag is so sensed.

9. Apparatus according to claim 1, wherein said means for sending a signal to a weighing machine comprises a bag sensor adjacent said second position, and means adapted for preventing the weighing machine from dumping when said bag sensor fails to indicate the presence of a bag.

10. Apparatus according to claim 9, further comprising means for stopping said conveying means, and wherein said controlling means further is adapted to receive a signal from the weighing machine which indicates the weighing machine has begun to dispense an amount of foodstuffs, and is constructed to activate said stopping means if said signal is not received within a predetermined time after the bag is sensed, whereby the foodstuffs are not dumped outside of said hopper means.

11. Apparatus according to claim 1, wherein said means for sending a signal to a weighing machine comprises a bag sensor adjacent said second position.

12. Apparatus according to claim 11 further comprising means for adjusting the speed of said conveying means.

13. Apparatus according to claim 10, wherein said controlling means comprising means for adjusting said predetermined time.

14. An assembly for weighing and bagging foodstuffs such as potatoes, comprising:

weighing machine means for receiving bulk quantities of foodstuffs and separating the foodstuffs into discrete loads of like weight;

hopper means positioned beneath said weighing machine means for receiving a preweighed load of foodstuffs from said weighing machine means, said hopper means having a downwardly directed chute;

gripping means, positioned beneath said chute, which is adapted for selectively gripping or releasing a pre-made bag;

conveying means for moving said hopper means and said gripping means together as a unit in a continuous motion along a closed path; and means for controlling said gripping means an said conveying means so that said gripping means is caused to (a) grip a bag when said conveying means is in a first position along said path; (b) move said conveying means through a second position along said path, whereupon foodstuffs may be loaded into said hopper means; and (c) cause the gripping means to release the bag at a third position along said path, said controlling means further comprising means adapted for sending a signal to a weighing machine to dump a load of foodstuffs having a predetermined weight into said hopper means when said conveying means travels through said second position, whereby such foodstuffs may be efficiently bagged.

15. An assembly according to claim 14, further comprising means for imparting vibration to said hopper means, whereby foodstuffs are less likely to become stuck on said chute.

16. An assembly according to claim 14, wherein said conveying means comprises for mounting said hopper means and said gripping means for rotation about an axis, and means for moving said hopper means and gripper means about said axis.

17. Apparatus according to claim 16, wherein said moving means includes a continuously variable speed control.

18. An assembly according to claim 14, wherein said controlling means comprises closing means for sensing when a bag is positioned within said gripping means and for closing said gripping means when a bag is so sensed.

19. An assembly according to claim 14, wherein said means for sending a signal to a weighing machine comprises a bag sensor adjacent said second position, and means for preventing said weighing machine from dumping a load of foodstuffs when said bag sensor fails to indicate the presence of a bag.

20. An assembly according to claim 19, further comprising means for stopping said conveying means, and wherein said weighing machine means comprises means for sending a signal when said weighing machine means is dispensing a load of foodstuffs, and said controlling means further comprises means for receiving said signal, and is constructed to actuate said stopping means if said signal is not received within a predetermined time after the bag is sensed, whereby the load of foodstuffs is not dumped outside of said hopper means.

21. Apparatus according to claim 20, wherein said controlling means comprises means for adjusting said predetermined time.

22. An apparatus according to claim 15, wherein said means for imparting vibration comprises first vibrating means for creating vibration in a first direction, and second vibrating means for creating vibration in a second direction.

23. An assembly according to claim 14, wherein said gripping means comprises a pair of stationary outer grippers and a pair of moveable inner grippers which are adapted to spread open a bag and clamp opposite sides of the bag against said stationary grippers.

24. Apparatus according to claim 23, wherein each of said stationary grippers are adjustable in order to permit bags having different sizes to be clamped in said gripping means.

25. Assembly according to claim 14, wherein said means for sending a signal to a weighing machine comprises a bag sensor adjacent said second position, and said weighing machine means comprises dumping means for dumping a discrete predetermined weight of foodstuffs into said hopper means, said dumping means having an inherent known lag time between receiving said signal and the time foodstuffs are received in said hopper means.

26. Assembly to claim 25, further comprising means for adjusting the speed of said conveying means so that said hopper means will pass through said second position at the end of said lag time.

27. An apparatus for bagging foodstuffs, comprising:

a rotatable carousel having an upper surface, said upper surface having a plurality of hopper compartments defined therein, each of said hopper compartments including a downwardly-directed chute;

means for imparting vibration to said carousel;

a pair of grippers, positioned beneath each of the said chutes, which are adapted for selectively gripping or releasing a bag;

a motor for rotating said carousel; and a controller for controlling said grippers and said motor so that, in normal operation, the grippers grip a bag when said carousel is in a first position; the carousel turns through a second position, whereupon foodstuffs may be loaded into one of the hoppers; and the grippers are caused to release the bat at a third position, whereby such foodstuffs may be efficiently bagged.

28. An apparatus according to claim 27, wherein said means for imparting vibration comprises first vibrating means for creating vibration in a first direction, and second vibrating means for creating vibration in a second direction.

* * * * *